US008547306B2

(12) United States Patent
Tanaka et al.

(10) Patent No.: US 8,547,306 B2
(45) Date of Patent: Oct. 1, 2013

(54) DISPLAY DEVICE AND DRIVING METHOD THEREOF

(75) Inventors: Masahiro Tanaka, Chiba (JP); Toshiyuki Matsuura, Mobara (JP); Hajime Murakami, Shinjuku (JP); Hajime Akimoto, Kokubunji (JP)

(73) Assignees: Hitachi Displays, Ltd., Chiba (JP); Panasonic Liquid Crystal Display Co., Ltd., Hyogo-Ken (JP)

( * ) Notice: Subject to any disclaimer, the term of this patent is extended or adjusted under 35 U.S.C. 154(b) by 751 days.

(21) Appl. No.: 12/706,278

(22) Filed: Feb. 16, 2010

(65) Prior Publication Data

US 2010/0141616 A1 Jun. 10, 2010

Related U.S. Application Data

(62) Division of application No. 11/295,499, filed on Dec. 7, 2005, now Pat. No. 7,701,420.

(30) Foreign Application Priority Data

Dec. 8, 2004 (JP) ..... 2004-355401

(51) Int. Cl.
*G09G 3/30* (2006.01)

(52) U.S. Cl.
USPC ..... 345/76; 345/205; 345/690

(58) Field of Classification Search
USPC ..... 375/76, 205, 690
See application file for complete search history.

(56) References Cited

U.S. PATENT DOCUMENTS

| | | | | |
|---|---|---|---|---|
| 5,373,377 | A * | 12/1994 | Ogawa et al. | 349/40 |
| 6,710,757 | B2 | 3/2004 | Wu | |
| 6,714,178 | B2 | 3/2004 | Koyama et al. | |
| 6,762,564 | B2 | 7/2004 | Noguchi et al. | |
| 6,864,637 | B2 | 3/2005 | Park et al. | |
| 7,071,613 | B2 | 7/2006 | Kim et al. | |
| 7,173,593 | B2 | 2/2007 | Matsumura et al. | |
| 7,176,620 | B2 * | 2/2007 | Tsujimura et al. | 313/506 |
| 7,468,580 | B2 | 12/2008 | Kawase | |
| 2003/0146890 | A1 * | 8/2003 | Sasaki | 345/87 |
| 2004/0041753 | A1 | 3/2004 | Nakanishi | |

FOREIGN PATENT DOCUMENTS

| | | |
|---|---|---|
| CN | 1413069 | 4/2003 |
| CN | 1490877 | 4/2004 |
| JP | 8-28038 | 1/1996 |
| JP | 11-40362 | 2/1999 |

(Continued)

*Primary Examiner* — William Boddie
*Assistant Examiner* — Leonid Shapiro
(74) *Attorney, Agent, or Firm* — Antonelli, Terry, Stout & Kraus, LLP.

(57) ABSTRACT

The present invention enhances a display quality of a display device as a task. As means for solving such a task, the present invention provides a display device including a light emitting element and a switching element in a pixel, wherein the switching element is provided for supplying a power source to the light emitting element and is constituted of a first switching element and a second switching element. The first switching element and the second switching element are configured to be operated, in response to inputting of data signals into the inside of the pixel, one switching element assumes a positive bias state and another switching element assumes a reverse bias state, and the bias states are alternately changed over between the first switching element and the second switching element in response to time-sequential inputting of the data signals, and the supply of the power source to the light emitting element is performed by way of either one of the first switching element and the second switching element.

6 Claims, 4 Drawing Sheets

(56) References Cited

FOREIGN PATENT DOCUMENTS

| | | | |
|---|---|---|---|
| JP | 2001-202032 | | 7/2001 |
| JP | 2002-32037 | | 1/2002 |
| JP | 2003-84689 | | 3/2003 |
| JP | 2003-084689 | * | 3/2003 |
| JP | 2003-123988 | | 4/2003 |
| JP | 2003-330387 | | 11/2003 |
| JP | 2004-102245 | | 4/2004 |
| JP | 2004-102246 | | 4/2004 |

* cited by examiner

DISPLAY DEVICE AND DRIVING METHOD THEREOF

CROSS-REFERENCE TO RELATED APPLICATIONS

This application is a divisional application of U.S. application Ser. No. 11/295,499, filed Dec. 7, 2005, now U.S. Pat. No. 7,701,420 the contents of which are incorporated herein by reference.

The disclosure of Japanese Patent Application No. JP2004-355401 filed on Dec. 8, 2004 including the specification, drawings and abstract is incorporated herein by reference in its entirety.

BACKGROUND OF THE INVENTION

1. Field of the Invention

The present invention relates to a display device and a driving method thereof, for example, an organic EL display device and a driving method thereof.

2. Description of the Related Art

An active-matrix-type organic EL display device is, for example, configured such that respective pixels which are arranged in parallel in the x direction are selected in response to scanning signals and data signals are supplied to respective pixels in conformity with the selection timing.

In each pixel to which the data signal is supplied, the data signal is stored in a capacitive element, a switching element (a drive switching element) is driven by the stored charge, and a power source is supplied to an organic EL element through the drive switching element.

With respect to this switching element, although one switching element is used in one pixel usually, there has been known an organic EL display device which uses a plurality of switching elements in one pixel as disclosed in patent documents such as Japanese Patent Laid-open 2003-84689 (patent document 1), Japanese Patent Laid-open 2001-202032 (patent document 2) and Japanese Patent Laid-open Hei8 (1996)-328038 (patent document 3), for example.

Here, the patent document 1 discloses a technique which aims at the uniform brightness of pixels. The patent document 2 discloses a technique which aims at the redundancy by using a plurality of pixels as one pixel. The patent document 3 discloses a technique which sets a total of parasitic capacitances to a fixed value even when an alignment displacement occurs.

[Patent reference 1] JP-A-2003-84689
[Patent reference 2] JP-A-2001-202032
[Patent reference 3] JP-A-8-328038

SUMMARY OF THE INVENTION

It is found out, however, that, in the display device having the above-mentioned constitution, since the drive switching elements are always driven during an operation of the display device, there arises a so-called Vth shift which is a phenomenon that a Vth (a threshold value voltage) is changed.

Particularly, it is found that when an N-channel-type switching element is used as the drive switching element, a drawback attributed to the Vth shift becomes apparent.

Further, when the Vth shift occurs in the drive switching elements which drive organic EL elements which constitute respective pixels of an active-matrix-type organic EL display device, a magnitude of a flowing electric current and a flow time of the electric current are changed thus giving rise to a possibility that the light is not emitted in a state the pixels can obtain the desired brightness.

Further, the drive switching element is formed on a portion of a pixel region and hence, a region for forming the drive switching elements is limited to ensure a sufficient light quantity whereby it is difficult to ensure the sufficient mobility of electrons.

Particularly, it is found out that when amorphous silicon, for example, is used for forming a semiconductor layer of the drive switching element, the mobility of electrons in amorphous silicon is lower than the mobility of electrons in polysilicon and hence, it is necessary to take any countermeasure to enhance the mobility of electrons in amorphous silicon.

The present invention has been made under such circumstances and it is an object of the present invention to provide a display device which allows respective pixels to emit desired quantities of light from respective pixels by suppressing a Vth shift of drive switching elements.

Further, it is another object of the present invention to provide a display device which ensures a sufficient current quantity for obtaining given light emitting quantities by driving organic EL elements through drive switching elements thus suppressing the brightness irregularities over a whole screen.

To briefly explain the summary of typical inventions among inventions disclosed in this specification, they are as follows.

(1) The display device according to the present invention, for example, includes at least a light emitting element and a switching element in a pixel, wherein the switching element is provided for supplying a power source to the light emitting element through the switching element and is constituted of a first switching element and a second switching element, the first switching element and the second switching element are configured to be operated such that, in response to inputting of data signals into the inside of the pixel, one switching element assumes a positive bias state and another switching element assumes a reverse bias state, and the bias states are alternately changed over between the first switching element and the second switching element in response to time-sequential inputting of the data signals, and the supply of the power source to the light emitting element is performed by way of either one of the first switching element and the second switching element, (2) The display device according to the present invention is, for example, on the premise of the constitution (1), characterized in that the changeover of the bias states of the first switching element and the second switching element is performed for respective data signals which are sequentially inputted.

(3) The display device according to the present invention, for example, includes a first data signal and a second data signal which are sequentially inputted to a pixel as data signals, the first data signal and the second data signal having a relationship that the first data signal and the second data signal are inverted from each other and the inversion is repeated time-sequentially, wherein the pixel includes at least:

a third switching element and a fourth switching element which are driven in response to a signal from a gate signal line;

a first capacitive element in which a charge corresponding to the first data signal is stored by way of the third switching element and a second capacitive element in which a charge corresponding to the second data signal is stored by way of the fourth switching element;

a first switching element which is driven by the charge stored in the first capacitive element and a second switching element which is driven by the charge stored in the second capacitive element; and a light emitting element to which a power source is supplied through the first switching element or the second switching element.

(4) The display device according to the present invention is, for example, on the premise of the constitution (3), characterized in that the first data signal is inputted through a first data signal line and the second data signal is inputted through a second data signal line.

(5) The display device according to the present invention is, for example, on the premise of the constitution (3), characterized in that the inversion of the first data signal and the second data signal is performed for respective data signals inputted sequentially.

(6) The display device according to the present invention, for example, includes a first scanning signal and a second scanning signal which are sequentially inputted to a pixel as scanning signals, the first scanning signal and the second scanning signal having a relationship that when an ON signal is inputted as one scanning signal and an OFF signal is inputted as another scanning signal and the relationship is changed over during a scanning step, wherein the pixel includes at least:

a light emitting element, and a first switching element and a second switching element which supply a power source to the light emitting element through either one of the switching elements;

a fifth switching element which is driven by the ON signal of the first scanning signal and supplies the OFF signal of the second scanning signal to a gate electrode of the first switching element, and a sixth switching element which is driven by the ON signal of the second scanning signal and supplies the OFF current of the first scanning signal to a gate electrode of the second switching element;

a third switching element which is driven in response to the ON signal of the second scanning signal, and a fourth switching element which is driven in response to the ON signal of the first scanning signal; and a first capacitive element which stores a charge corresponding to the data signal through the third switching element and also drives the first switching element, and a second capacitive element which stores a charge corresponding to the data signal through the fourth switching element and also drives the second switching element.

(7) The display device according to the present invention is, for example, on the premise of the constitution (6), characterized in that the first scanning signal is inputted through a first gate signal line and the second scanning signal is inputted through a second gate signal line.

(8) The display device according to the present invention is, for example, on the premise of the constitution (6), characterized in that the changeover of turning ON and OFF of the first scanning signal and the second scanning signal is performed for respective frames.

(9) A driving method of a display device according to the present invention is, for example, a method for driving the display device which includes a light emitting element and a first switching element and a second switching element which supply a power source to the light emitting element through either one of the switching elements in a pixel, wherein in a step of sequentially inputting data signals to the inside of the pixel, the first switching element and the second switching element are operated in a state that one switching element assumes a positive bias state and another switching element assumes a reverse bias state and the bias states are alternately changed over between the first switching element and the second switching element.

(10) The driving method of a display device according to the present invention is, for example, on the premise of the constitution (9), characterized in that the alternating changeover of the bias states of the first switching element and the second switching element is performed for every data signal inputted to the inside of the pixel.

(11) The display device according to the present invention is, for example, on the premise of any one of constitutions (1), (2), (3), (6), characterized in that the first switching element and the second switching element have respective channel regions thereof formed in a zigzag pattern.

(12) The display device according to the present invention is, for example, on the premise of any one of constitutions (1), (2), (3), (6), characterized in that the first switching element and the second switching element are formed on a side below a light emitting layer and one electrode formed above the light emitting layer is formed of a light-transmitting conductive layer.

(13) The display device according to the present invention is, for example, on the premise of any one of constitutions (1), (2), (3), (6), (11), (12), characterized in that both of the first switching element and the second switching element are formed of an N-channel-type switching element,

(14) The display device according to the present invention is, for example, on the premise of any one of constitutions (1), (2), (3), (6), (11), (12), characterized in that both of the first switching element and the second switching element have a semiconductor layer thereof formed of amorphous silicon.

Here, the present invention is not limited by the above-mentioned constitutions and various modifications are conceivable without departing from the technical concept of the present invention.

DESCRIPTION OF THE PREFERRED EMBODIMENTS

Hereinafter, embodiments of a display device and a driving method thereof according to the present invention are explained in conjunction with drawings.

Embodiment 1

Figure 1:
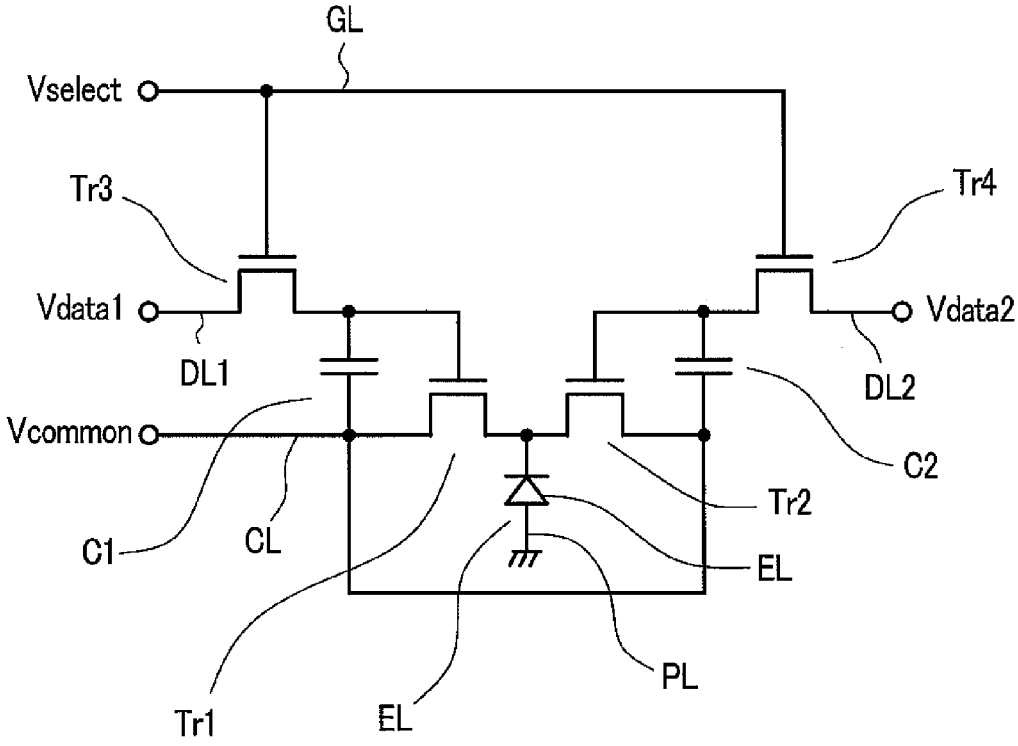
FIG. 1 is an equivalent circuit diagram showing one embodiment of the constitution of a pixel of a display device according to the present invention.

FIG. 1 is an equivalent circuit diagram showing one embodiment of the constitution of a pixel of a display device according to the present invention. As an embodiment of the display device, for example, an active-matrix-type organic EL display device is described.

Accordingly, respective pixels are arranged in a matrix array, wherein a pixel group of respective pixels arranged in parallel in the x direction adopt a gate signal line GL described later in common, and a pixel group of respective pixels arranged in parallel in the y direction adopt a first data signal line DL1 and a second data signal line DL2 in common.

Here, a first switching element Tr1 to a fourth switching element Tr4 which are used in the equivalent circuit are constituted of an N-channel-type MIS (Metal Insulator Semiconductor) transistor, for example.

In FIG. 1, first of all, the N-channel-type MIS transistor includes, first of all, the third switching element Tr3 and the third switching element Tr3 is configured to perform an ON operation in response to the supply of a scanning signal Vselect from the gate signal line (pixel selection signal line) GL.

A first data signal Vdata1 is supplied to the third switching element Tr3 through the first data signal line DL1, and the first data signal Vdata1 is configured to be stored in a first capacitive element C1 which has one end thereof connected to a common voltage signal line CL when the third switching element Tr3 is turned ON.

Further, the N-channel-type MIS transistor includes a the first switching element Tr1 which is turned ON due to a charge stored in the first capacitive element C1, and an electric current flows in an organic EL element EL which has one end thereof connected to a power source supply signal line PL through the first switching element Tr1 and this electric current is led to the common voltage signal line CL. Here, a common voltage Vcommon is supplied to the common voltage signal line CL On the other hand, the N-channel-type MIS transistor includes a fourth switching element Tr4 which is turned ON with the supply of a signal from the gate signal line GL, wherein a second data signal Vdata2 is supplied to the fourth switching element Tr4 through a second data signal line DL2.

The second data signal Vdata2 is, when the fourth switching element Tr4 is turned ON, stored in a second capacitive element C2 which has one end thereof connected to the common voltage signal line CL.

Further, the N-channel-type MIS transistor includes a second switching element Tr2 which is turned ON due to a charge stored in the second capacitive element C2, an electric current flows in the organic EL element EL through the second switching element Tr2, and the electric current is led to the common voltage signal line CL.

Here, the first switching element Tr2 and the second switching element Tr2 are referred to as so-called drive switching elements.

Figure 2:
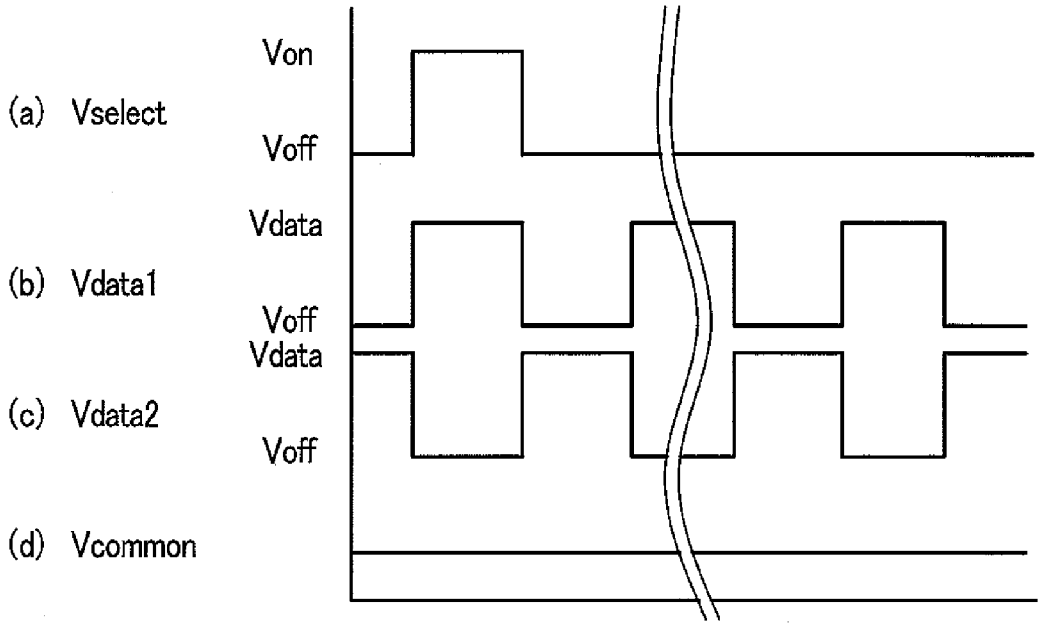
FIG. 2 is an operational timing chart in the equivalent circuit diagram shown in FIG. 1.

FIG. 2 is a signal timing chart showing the manner of operation of the above-mentioned equivalent circuit.

In FIG. 2, (a) shows a waveform of the scanning signal V select, (b) indicates a waveform of the first data signal Vdata1, (c) indicates a waveform of the second data signal Vdata2, and (d) shows a common voltage Vcommon.

When the scanning signal Vselect assumes Von and is inputted, the third switching element Tr3 and the third switching element Tr3 and the fourth switching element Tr4 are simultaneously turned ON.

The first data signal Vdata1 is supplied to the third switching element Tr3 which is turned ON, the first data signal Vdata1 is stored (written) in the first capacitive element C1, the second data signal Vdata2 is supplied to the fourth switching element Tr4 which is turned ON, and the second data signal Vdata2 is stored (written) in the second capacitive element C2.

In this case, the first data signal Vdata1 and the second data signal Vdata2 assume, as shown in (b) and (c) of FIG. 2, the inverse relationship in which when the first data signal Vdata1 becomes positive with respect to the common voltage Vcommon in the first frame, for example, the second data signal Vdata2 becomes negative with respect to the common voltage Vcommon.

Further, with respect to the first data signal Vdata1 and the second data signal Vdata2, in the next frame, the first data signal Vdata1 becomes negative with respect to the common voltage Vcommon and the second data signal Vdata2 becomes positive with respect to the common voltage Vcommon. Further, in the next frame, the first data signal Vdata1 becomes positive with respect to the common voltage Vcommon and the second data signal Vdata2 becomes negative with respect to the common voltage Vcommon. In the frames which follow thereafter, the above-mentioned inversion is sequentially repeated.

Further, when the above-mentioned first data signal Vdata1 and the second data signal Vdata2 are inputted in the first frame, for example, the first data signal Vdata1 which is positive with respect to the common voltage Vcommon contributes as pixel information which drives an organic EL element EL, while the second data signal Vdata2 which is negative with respect to the common voltage Vcommon does not contribute as pixel information.

Accordingly, in the next frame, the first data signal Vdata1 which is negative with respect to the common voltage Vcommon does not contribute as pixel information, while the second data signal Vdata2 which is positive with respect to the common voltage Vcommon contributes as pixel information.

This implies that when the first data signal Vdata1 is positive with respect to the common voltage Vcommon, for example, the first switching element Tr1 to which the charge is applied through the first capacitive element C1 assumes a positive bias state, while the second data signal Vdata2 becomes negative with respect to the common voltage Vcommon and the second switching element Tr2 to which the charge is applied through the second capacitive element C2 assumes a negative (reverse) bias state. These states are alternately changed over for every frame cycle.

Here, the fact that the first switching element Tr1 assumes the positive bias state implies that the voltage which is applied to the gate electrode is positive with respect to the electrode connected to the common voltage signal line CL of the first switching element Tr1, while the fact that the second switching element Tr2 assumes the reverse bias state implies that the voltage applied to the gate electrode is negative with respect to the voltage applied to the electrode connected to the common voltage signal line CL of the second switching element Tr2.

Accordingly, the switching element Tr in the positive bias state is driven to allow an electric current to flow in the organic EL element EL, while the driving of the switching element Tr in the reverse bias state is stopped and, in this stopped state, the Vth shift when the switching element is driven in a stage of a one preceding frame is cancelled by the application of the reverse bias. This step is alternately repeated each time the frame is changed over.

Accordingly, it is possible to largely suppress the generation of the Vth shift in the first switching element Tr1 and the second switching element Tr2 respectively.

From the above, it is needless to say that the changeover of the respective bias states of the first switching element Tr1 and the second switching element Tr2 is not limited to every 1 frame and the substantially equal advantageous effects can be obtained for every plural frames.

In short, the changeover of the respective bias states of the first switching element Tr1 and the second switching element Tr2 may be performed in a sequential step of the data signals V data 1 and V data 2 to the inside of the pixel.

Figure 3:
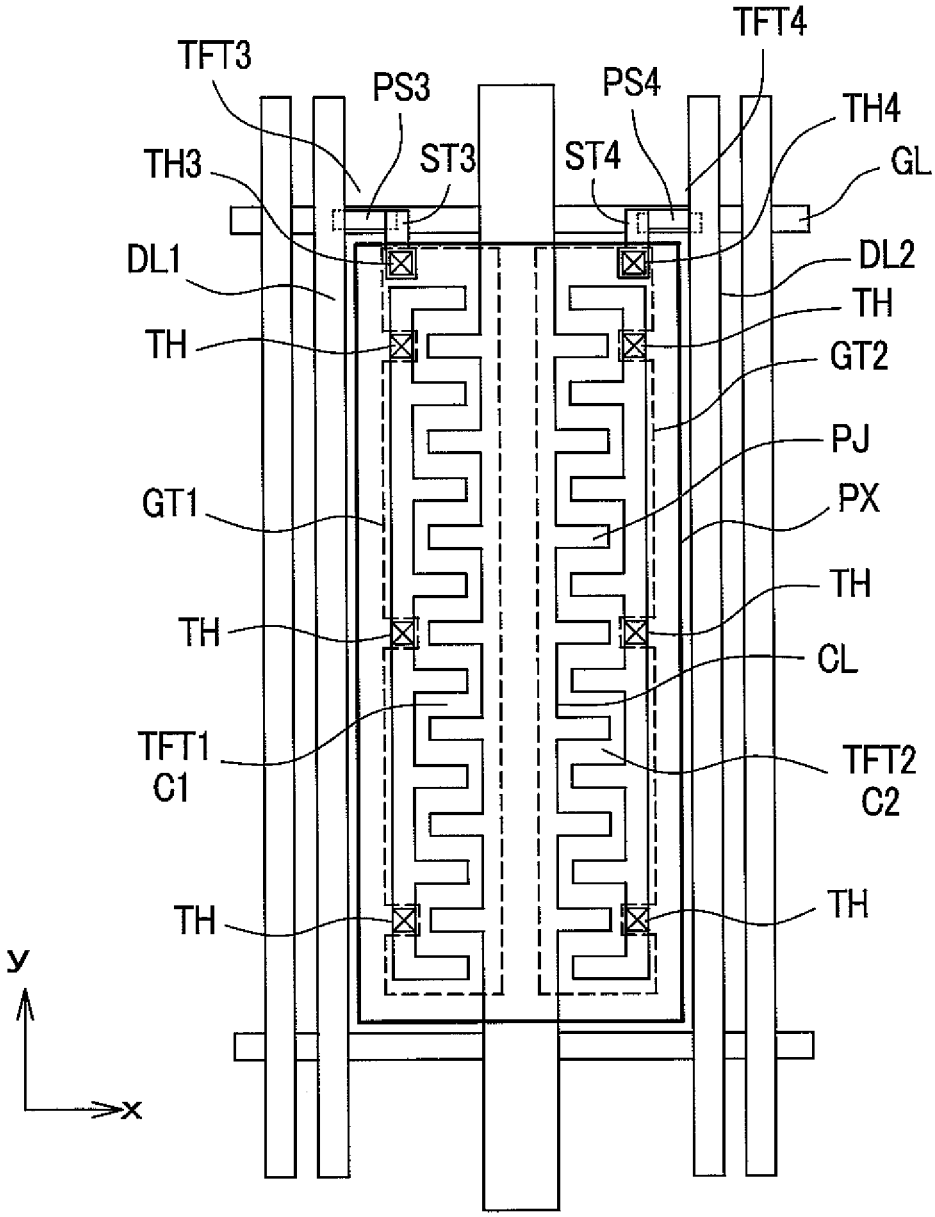
FIG. 3 is a plan view showing another embodiment of the constitution of the pixel which includes the equivalent circuit shown in FIG. 1.

FIG. 3 is a plan view showing one embodiment of the specific constitution of the pixel to which the equivalent circuit shown in FIG. 1 is provided. Here, in FIG. 3, one pixel is formed in the inside of a region which is surrounded by the pair of gate signal lines GL which extend in the x direction and are arranged in parallel in the y direction and the first data signal line DL1 and the second data signal line DL2 which extend in the y direction and are arranged in parallel in the x direction.

Further, the respective semiconductor layers PS1 to PS4 of the thin film transistors TFT1 to TFT4 shown in FIG. 3 respectively adopt poly-silicon, for example.

Here, the organic EL layer (organic EL element) EL and the power source supply signal line PL are omitted from the drawing. These parts are omitted for preventing the drawing from becoming complicated.

Further, in FIG. 3, the thin film transistor TFT1 corresponds to the first switching element Tr1 shown in FIG. 1. The thin film transistor TFT2 corresponds to the second switching element Tr2 shown in FIG. 1, the thin film transistor TFT3 corresponds to the third switching element Tr1 shown in FIG. 1, and the thin film transistor TFT4 corresponds to the fourth switching element Tr4 shown in FIG. 1.

In FIG. 3, on a main surface of an insulation substrate made of glass or the like, for example, first of all, the gate signal lines GL which extend in the x direction in the drawing are formed.

Further, a first insulation film (not shown in the drawing) is formed on a surface of the insulation substrate in a state that the insulation film covers the gate signal lines GL. The first insulation film functions as gate insulation films of the thin film transistors TFT3, TFT4 described later and a film thickness of the first insulation film is set in conformity with the gate insulation films.

The semiconductor layers PS3 and PS4 are formed in a state that the semiconductor layers PS3 and PS4 are overlapped to an upper surface of the first insulation film as well as to portions of the gate signal lines GL. The semiconductor layer PS3 is formed on a side close to the first data signal line DL1 described later, while the semiconductor layer PS4 is formed on a side close to the second data signal line DL2 described later.

This is because that the semiconductor layer PS3 is constituted as a semiconductor layer of the thin film transistor TFT3 described later and the semiconductor layer PS4 is constituted as a semiconductor layer of the thin film transistor TFT4 described later.

Further, the pixel includes the first data signal line DL1 and the second data signal line DL2. The first data signal line DL1 is formed on a portion of the semiconductor layer PS3 in an overlapped manner, wherein the first data signal line DL1 constitutes a drain electrode of the thin film transistor TFT3 at the overlapped portion. Further, the second data signal line DL2 is formed on a portion of the semiconductor layer PS4 in an overlapped manner, wherein the second data signal line DL2 constitutes a drain electrode of the thin film transistor TFT4 at the overlapped portion.

Further, for example, simultaneously with the formation of the first data signal line DL1 and the second data signal line DL2, a source electrode ST3 of the thin film transistor TFT3 and a source electrode ST4 of the thin film transistor TFT4 are formed. These respective source electrodes ST3, ST4 are formed in a state that the respective source electrodes ST3, ST4 slightly extend toward a center side of the pixel region to connect a gate electrode GT1 of the thin film transistor TFT1 and a gate electrode GT2 of the thin film transistor TFT2 described later respectively via through holes.

Further, for example, simultaneously with the formation of the first data signal line DL1 and the second data signal line DL2, the common voltage signal line CL is formed. The common voltage signal line CL is formed in a state that the common voltage signal line CL passes the substantially center of the pixel region and extends in the y direction.

Further, the common voltage signal line CL is, in the inside of the pixel region, formed in a pattern (a fishbone pattern) in which projecting portions PJ which extend in the direction intersecting the extending direction of the common voltage signal line CL from both sides are formed in parallel in the above-mentioned extending direction. These projecting portions PJ constitute one electrode (a group of electrodes) of the thin film transistor TFT1 described later on the right side in the drawing, while constitute one electrode (a group of electrodes) of the thin film transistor TFT2 described later on the left side in the drawing.

Further, another electrodes of the thin film transistors TFT1, TFT2 are formed simultaneously with the formation of the above-mentioned first data signal line DL1 and second data signal line DL2. Another electrode of the thin film transistor TFT1 is constituted as a group of electrodes in which respective electrodes thereof are arranged in a state that the respective electrodes (the above-mentioned projecting portions PJ) of the above-mentioned one group of electrodes of the thin film transistor TFT1 are sandwiched between the electrodes of another electrode and, at the same time, another electrode forms a comb-shaped pattern for establishing an electrical connection. In the same manner, another electrode of the thin film transistor TFT2 is constituted as a group of electrodes in which respective electrodes thereof are arranged in a state that the respective electrodes (the above-mentioned projecting portions PJ) of the above-mentioned one group of electrodes of the thin film transistor TFT2 are sandwiched between the electrodes of another electrode and, at the same time, another electrode forms a comb-shaped pattern for establishing an electrical connection.

In the inside of the region of one pixel, using an imaginary line segment which passes the center and extends in the y direction as a boundary, the semiconductor layers PS1, PS2 are formed separately from each other in a state that the semiconductor layer PS1 is formed in the left-side region and the semiconductor layer PS2 is formed in the right-side region.

The semiconductor layer PS1 and the semiconductor layer PS2 are, although not shown in the drawing, formed on portions corresponding to regions indicated by the gate electrode GT1 and the gate electrode GT2 described later (regions surrounded by a dotted line in the drawing), for example.

This is because that the semiconductor layer PS1 is constituted as a semiconductor layer of the thin film transistor TFT1 described later and the semiconductor layer PS2 is constituted as a semiconductor layer of the thin film transistor TFT2 described later.

Further, a second insulation film (not shown in the drawing) is formed on the surface of the insulation substrate in a state that the second insulation film also covers the respective semiconductor layers PS1 and PS2. The second insulation film functions as gate insulation films of the thin film transistors TFT1, TFT2 described later and a film thickness of the second insulation film is set in conformity with the gate insulation films.

On a surface of the second insulation film, the gate electrode GT1 of the thin film transistor TFT1 and the gate electrode GT2 of the thin film transistor TFT2 are formed. The gate electrode GT1 of the thin film transistor TFT1 is formed on the region where the semiconductor layer PS1 is formed in an overlapped manner and an extended portion of the gate electrode GT1 is connected with the source electrode ST3 of the thin film transistor TFT3 via a through hole TH3 formed in the second insulation film arranged below the gate electrode GT1. In the same manner, the gate electrode GT2 of the thin film transistor TFT2 is formed on the region where the semiconductor layer PS2 is formed in an overlapped manner and an extended portion of the gate electrode GT2 is connected with the source electrode ST4 of the thin film transistor TFT4 via a through hole TH4 formed in the second insulation film arranged below the gate electrode GT2.

A pixel electrode PX is formed on a surface of the insulation substrate by way of a third insulation film (not shown in the drawing) in a state that the pixel electrode PX also covers the respective gate electrodes GT1, GT2. The pixel electrode PX is formed over a substantially whole area of the pixel region for enhancing a so-called numerical aperture of the pixel and is connected with another electrodes (electrodes different from the electrodes which are integrally formed with the common voltage signal line CL) of the thin film transistors TFT1, TFT2 via through holes TH which are formed in the third insulation film and the second insulation film arranged below the pixel electrode PX in a penetrating manner. In this case, portions where the through holes TH are formed respectively adopt a pattern in which the portions corresponding to the gate electrode GT1, GT2 are preliminarily notched to avoid the exposure of the gate electrode GT1, GT2. This pattern is provided for preventing the electrical connection between the pixel electrode PX and the respective gate electrode GT1, GT2. Further, the active-matrix-type organic EL display device of this embodiment adopts the top emission structure which emits light from a surface (an upper surface) of the substrate on which active elements are formed and hence, the pixel electrode PX is constituted of a metal electrode or a stacked film which forms a transparent conductive film made of IZO or ITO on a metal electrode.

Here, between the pixel electrode PX and the electrode (the electrode formed integrally with the common voltage signal line CL) of one of the thin film transistors TFT1, TFT2, capacitive elements C1 and C2 which use the second insulation film and the third insulation film as dielectric films are formed.

Over a whole area of an upper surface of the pixel electrode PX, an organic EL layer (not shown in the drawing) is formed. In this case, a charge transport layer, an electron transport layer or the like may be stacked including the organic EL layer. That is, only the organic EL layer may be constituted of a stacked body formed of the organic EL layer and the charge transport layer, a stacked body of the organic EL layer and the electron transport layer or a stacked body formed of the organic EL layer, the charge transport layer and the electron transport layer. Here, such a constitution may be referred to as a light emitting layer as a general term in this specification.

Further, a power source supply signal line PL is formed on an upper surface of the light emitting layer. The power source supply signal line PL is formed in common over the regions of the respective pixels, that is, over the whole area of a display part which is constituted of a mass of the respective pixels. Here, the power source supply signal line PL is formed of a light-transmitting conductive layer which is made of ITO (Indium Tin Oxide), IZO (Indium Zinc Oxide) or the like, for example, as a material thereof. This is because that this embodiment is directed to the structure which allows light from the light emitting layer to be irradiated to a front surface side of a paper surface of the drawing (the top emission structure).

Further, the constitution which forms the power source supply signal line PL as an upper layer in the layer structure in this manner is referred to as the so-called top anode structure. The top anode structure is configured to easily enhance the so-called numerical aperture of the pixel (the ratio of the light emitting area which occupies in the area of one pixel).

Here, in the above-mentioned constitution, the thin film transistors TFT3, TFT4 adopt the so-called inversely-staggered structure which forms the gate electrode (gate signal line GL) below the semiconductor layers PS3, PS4. However, it is needless to say that the constitution is not limited to such an inversely staggered structure and the staggered structure which forms the gate electrode above the semiconductor layers PS3, PS4 may be adopted.

In the same manner, it is needless to say that although the thin film transistors TFT1, TFT2 are constituted as the staggered structure, the thin film transistors TFT1, TFT2 may be constituted as the inversely-staggered structure.

Further, the thin film transistors TFT1, TFT2 are formed in an overlapped manner on the light emitting region in the inside of the pixel, that is, on the region where the organic EL layer is formed. However, it is needless to say that the formation of the thin film transistors TFT1, TFT2 is not limited to such a region and the thin film transistors TFT1, TFT2 may be formed in the inside of another region which is separated from the light emitting region as viewed in a plan view.

Here, the thin film transistors TFT1, TFT2 are respectively formed to occupy an approximately half of the region of the pixel and hence, these transistors are large-sized. Further, channel regions (regions formed between the pair of electrodes) of these transistors TFT1, TFT2 are formed in a zigzag pattern and hence, the channel regions have a large channel width. Accordingly, the mobility of electrons can be increased so as to largely enhance an ON current.

Particularly, when amorphous silicon, for example, is used as a material of the semiconductor layers PS1, PS2, since the amorphous silicon exhibits the small mobility of electrons, by adopting the above-mentioned constitution, it is possible to overcome the drawback.

Usually, an electric current which is allowed to flow into the drive switching element is 200 to 300 $A/m^2$, that is, approximately 7.5 μA per the pixel of 100×300 μm, for example, wherein when the semiconductor layer of the drive switching element is made of amorphous silicon, the mobility of electrons becomes approximately 0.5.

Accordingly, to allow the flow of the electric current of the above-mentioned 7.5 μA by setting a voltage applied to the gate electrode to 15V and a voltage between source and drain electrodes to approximately 10V, it is sufficient that the thin film transistors TFT1, TFT2 which constitute the drive switching elements respectively have a ratio between a channel width and a channel length of approximately 50.

When the channel length is 6 μm, it is sufficient to set a width of the semiconductor layers PS1, PS2 of the thin film transistors TFT1, TFT2 to approximately 300 μm, wherein a length of the semiconductor layers PS1, PS2 substantially corresponds to a length of the pixel.

The constitution of the pixel described in the above-mentioned embodiment adopts the top anode structure and hence, it is possible to form the thin film transistors TFT1, TFT2 over the whole region of the pixel whereby even when the semiconductor layers of the thin film transistors TFT1, TFT2 are made of amorphous silicon, for example, it is possible to allow the sufficient drive current to flow into these thin film transistors TFT1, TFT2.

Here, with respect to the drive switching element when the transistor is an N-channel-type transistor and the semiconductor layer is made of poly-silicon, the mobility of electrons becomes approximately 100 and hence, it is possible to reduce the size of the drive switching element.

Embodiment 2

Figure 4:
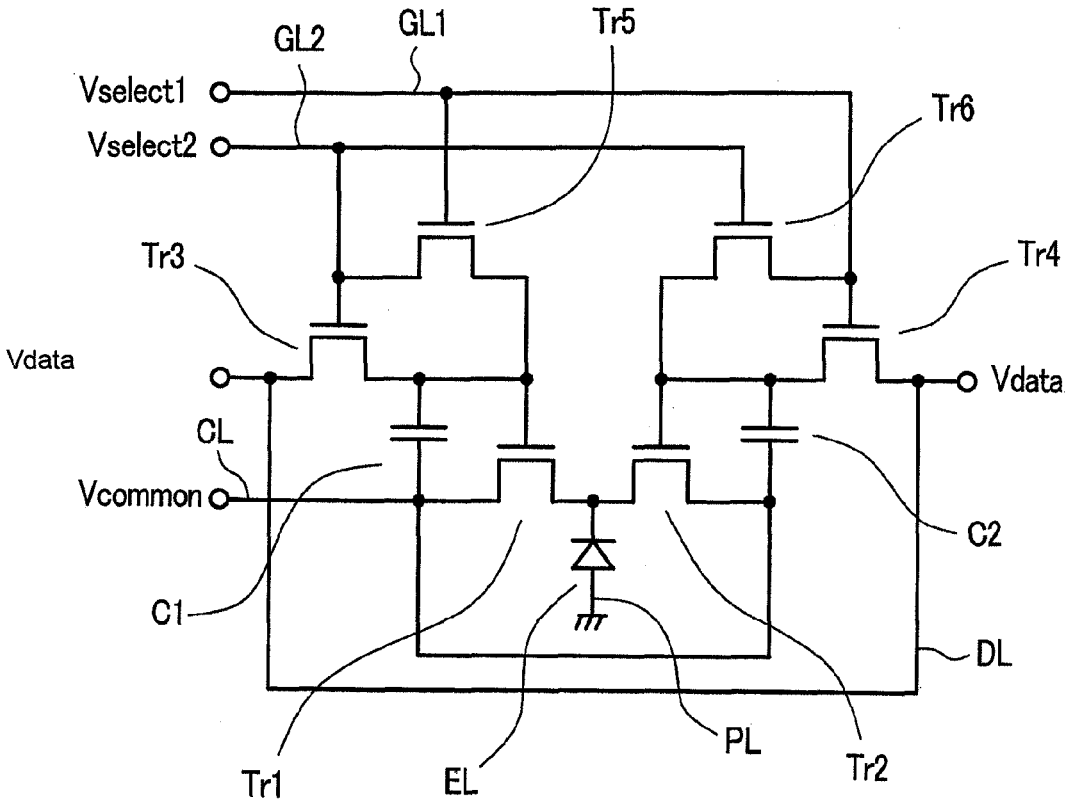
FIG. 4 is an equivalent circuit diagram showing another embodiment of the constitution of a pixel of a display device according to the present invention.

FIG. 4 is an equivalent circuit diagram showing another embodiment of the constitution of the pixel of the display device according to the present invention and corresponds to FIG. 1.

The constitution which makes this embodiment different from the embodiment shown in FIG. 1 lies in that, first of all, each pixel uses one data signal line DL and uses two gate signal lines GL instead of one gate signal line GL.

In a color display, for example, three pixels which are arranged close to each other in the running direction of the gate signal line GL are configured to emit lights of respective colors consisting of red (R), green (G), blue (B), and these respective pixels constitute a unit pixel of the color display.

In the equivalent circuit shown in FIG. 1, six data signal lines DL in total become necessary. However, by increasing one gate signal line GL which is formed in common with the respective pixels, it is possible to obtain an advantageous effect that the number of signal lines can be largely reduced as a whole.

In FIG. 4 which shows two gate signal lines GL, assuming one gate signal line as a first gate signal line GL1 and another gate signal line as a second gate signal line GL2, the pixel of this embodiment is constituted such that a fifth switching element Tr5 which is turned ON in response to a scanning signal Vselect1 from the first gate signal line GL1 and a sixth switching element Tr6 which is turned ON in response to a scanning signal Vselect2 from the second gate signal line GL2 are newly provided.

Further, different from the case shown in FIG. 1, a third switching element Tr1 is turned ON in response to the scanning signal Vselect2 from the second gate signal line GL2, while a fourth switching element Tr4 is turned ON in response to the scanning signal Vselect1 from a first gate signal line GL1.

The above-mentioned fifth switching element Tr5 has one end thereof connected to a gate electrode (an electrode to which the scanning signal Vselect2 from the second gate signal line GL2 is supplied) of the third switching element Tr3 and another end thereof connected to a gate electrode (an electrode to which a charge of a first capacitive element C1 is applied) of the first switching element Tr1. The sixth switching element Tr6 has one end thereof connected to a gate electrode (an electrode to which the scanning signal Vselect1 from the first gate signal line GL1 is supplied) of the forth switching element Tr4 and another end thereof connected to a gate electrode (an electrode to which a charge of a second capacitive element C2 is applied) of the second switching element Tr2.

Here, the respective connection relationships among the first capacitive element C1, the first switching element Tr1, the second capacitive element C2, the second switching element Tr2, the organic EL element EL and a terminal to which the common voltage Vcommon is supplied are substantially equal to the connection relationships in the case shown in FIG. 1.

Here, in the case shown in FIG. 1, the data signals which are inputted to the pixel include the first data signal Vdata1 1 and the second data signal Vdata2 which are inverted from each other, in this embodiment, the data signal inputted to the pixel includes only one data signal Vdata and the data signal Vdata is stored in the first capacitive element C1 through the third switching element Tr3 and, at the same time, is stored in the second capacitive element C2 through the fourth switching element Tr4.

Figure 5:
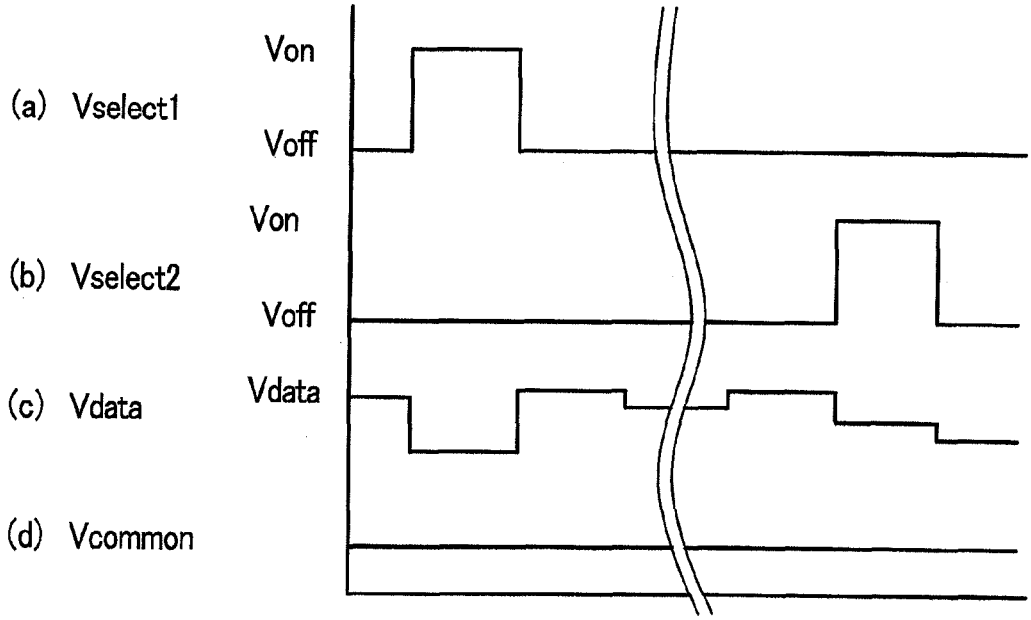
FIG. 5 is an operational timing chart in the equivalent circuit diagram shown in FIG. 4.

FIG. 5 is a signal timing chart showing the manner of operation of the above-mentioned equivalent circuit.

In FIG. 5, (a) shows a waveform of the first scanning signal V select1, (b) indicates a waveform of the second scanning signal Vselect2, (c) indicates a waveform of the data signal Vdata, and (d) shows a common voltage Vcommon.

Here, the timing chart illustrates an example in which, for example, the ON signal Von of the scanning signal Vselect1 is supplied to the first gate signal line GL1 in the initial frame (the ON signal Von of the scanning signal Vselect2 is not supplied to the second gate signal line GL2 in this frame), and the ON signal Von of the scanning signal Vselect2 is supplied to the second gate signal line GL2 in the next frame (the ON signal Von of the scanning signal Vselect1 is not supplied to the first gate signal line GL1 in this frame).

In the initial frame, when the scanning signal Vselect1 is inputted in response to the ON signal Von thereof, the fourth switching element Tr4 and the fifth switching element Tr5 are turned ON.

Among these switching elements Tr4, Tr5, the data signal Vdata is supplied to the fourth switching element Tr4 and the data signal Vdata is stored (written) in the second capacitive element C2.

The charge stored in the second capacitive element C2 turns ON the second switching element Tr2, the common voltage Vcommon is supplied to the organic EL element EL through the second switching element Tr2, and an electric current flows in the organic EL element EL from the power source supply signal line PL.

During such an operation, the ON signal Von of the scanning signal Vselect2 is not supplied to the second gate signal line GL2, while the OFF signal Voff at this point of time is applied to the gate electrode of the first switching element Tr1 through the fifth switching element Try which is turned ON in response to the scanning signal Vselect1.

Here, there is no possibility that the charge of the first capacitive element C1 which corresponds to the data signal Vdata is applied to the gate electrode of the first switching element Tr1. This is because that the second scanning signal Vselect2 which is formed of the OFF signal Voff is supplied to the gate electrode of the third switching element Tr3.

In the next frame, when the scanning signal Vselect2 is supplied in response to the ON signal Von thereof, the third switching element Tr3 and the sixth switching element Tr6 are turned ON.

Among these switching elements Tr3, Tr6, the data signal Vdata is supplied to the third switching element Tr3 and the data signal Vdata is stored (written) in the first capacitive element C1.

The charge stored in the first capacitive element C1 turns ON the first switching element Tr1, the common voltage Vcommon is supplied to the organic EL element EL through the first switching element Tr1, and an electric current flows in the organic EL element EL from the power source supply signal line PL.

During such an operation, the ON signal Von of the scanning signal Vselect1 is not supplied to the first gate signal line GL1, while the OFF signal Voff at this point of time is applied to the gate electrode of the second switching element Tr2 through the sixth switching element Tr6 which is turned ON in response to the scanning signal Vselect1.

Here, there is no possibility that the charge of the second capacitive element C2 which corresponds to the data signal Vdata is applied to the gate electrode of the second switching element Tr2. This is because that the first scanning signal Vselect1 which is formed of the OFF signal Voff is supplied to the gate electrode of the fourth switching element Tr4.

Also in the case of this embodiment, between the first switching element Tr1 and the second switching element Tr2, when one switching element is operated, another switching element is stopped and hence, it is possible to obtain an advantageous effect that the switching element on the stop side returns to the original state during the stop even when the Vth which is operated up to now is shifted.

Figure 6:
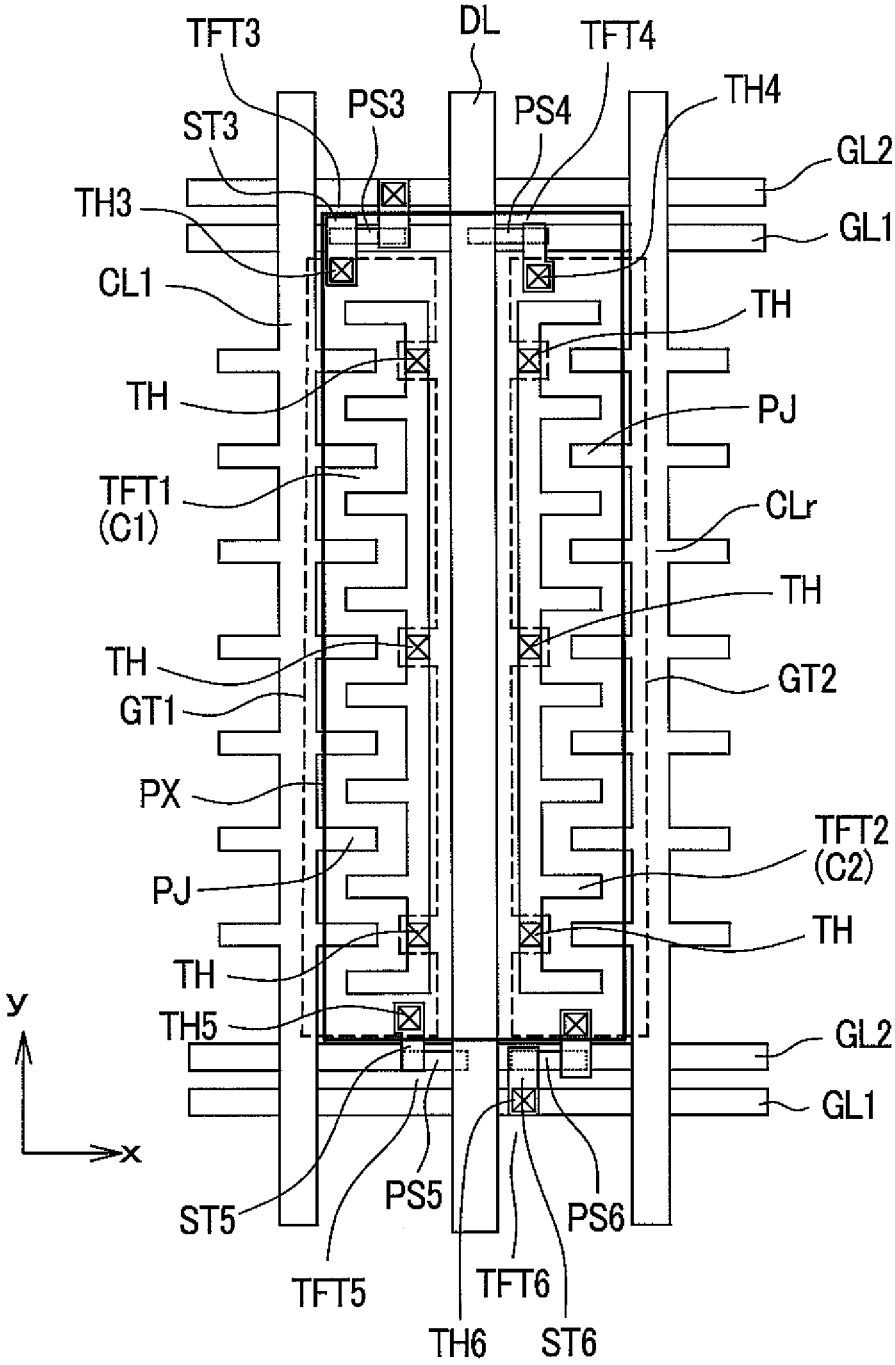
FIG. 6 is a plan view showing another embodiment of the constitution of the pixel which includes the equivalent circuit shown in FIG. 4.

FIG. 6 is a plan view showing one embodiment of the specific constitution of the pixel to which the equivalent circuit shown in FIG. 4 is provided. Here, in FIG. 6, one pixel is constituted in the inside of a region which is surrounded by the first gate signal line GL1 and the second gate signal line GL2 which extend in the x direction and are arranged in parallel in the y direction and the pair of common voltage signal lines CL which extend in the y direction and are arranged in parallel in the x direction.

Here, an organic EL layer EL and a power source supply signal line PL are omitted from the drawing. These parts are omitted for preventing the drawing from becoming complicated.

Further, in FIG. 6, a thin film transistor TFT1 to a thin film transistor TFT6 respectively correspond to the first transistor element Tr1 to the sixth transistor element Tr6 shown in FIG. 4.

Here, in the same manner as the embodiment 1, respective semiconductor layers of the thin film transistors TFT1 to TFT6 are made of poly-silicon, for example.

In FIG. 3, on a main surface of an insulation substrate made of glass or the like, for example, first of all, first gate signal lines GL1 and second gate signal lines GL2 which extend in the x direction and are arranged in parallel in the y direction in the drawing are formed.

Further, a first insulation film (not shown in the drawing) is formed on a surface of the insulation substrate in a state that the insulation film also covers the first gate signal lines GL1 and the second gate signal lines GL2. The first insulation film functions as gate insulation films of the thin film transistors TFT4 to TFT6 described later and a film thickness of the first insulation film is set in conformity with the gate insulation films.

Semiconductor layers PS4 and PS5 are formed in a state that the semiconductor layers PS4 and PS5 are overlapped to an upper surface of the insulation film as well as to portions of the first gate signal lines GL1 and the second gate signal lines GL2. The semiconductor layers PS4 and PS5 are respectively constituted as semiconductor layers of the thin film transistors TFT4, TFT5. Further, the semiconductor layers PS4 and PS5 are formed on sides different from each other with respect to a data signal line DL described later which is formed in a state that the data signal line DL extends over the center of the pixel and extends in the y direction. The semiconductor layers PS4 and PS5 are formed in a state that the semiconductor layers PS4 and PS5 extend over regions where the data signal line DL is formed. This provision is provided to allow one ends of the semiconductor layers PS4 and PS5 to be connected with the data signal line DL.

Further, on the first insulation film, the semiconductor layer PS3 is formed in a state that the semiconductor layer PS3 is overlapped to the gate signal line GL1 and the semiconductor layer PS6 is formed in a state that the semiconductor layer PS6 is overlapped to the gate signal line GL2. The semiconductor layers PS3 and PS6 respectively constitute semiconductor layers of the thin film transistors TFT3, TFT6. The semiconductor layer PS3 is formed on a side different from the semiconductor layer PS4 with the data signal line DL described later therebetween, while the semiconductor layer PS4 is formed on a side different from the semiconductor layer PS5 with the data signal line DL described later therebetween.

The semiconductor layer PS3 and the semiconductor layer PS6 are formed simultaneously with the formation of the semiconductor layer PS4 and the semiconductor layer PS5, for example.

Further, the pixel includes the data signal line DL and a common voltage signal line CL. The data signal line DL extends at the center of the pixel in the y direction, while the common voltage signal lines CL are formed at both sides of the data signal line DL to define the pixel from the neighboring pixels. In FIG. 6, the common voltage signal line CL which is positioned on the left side of the data signal line DL is expressed as a common voltage signal line CL1, while the common voltage signal line CL which is positioned on the right side of the data signal line DL is expressed as a common voltage signal line CLr. However, the common voltage signal line CL1 and the common voltage signal line CLr do not indicate different signal lines but are configured to be connected with each other in a region outside a display part which is constituted of a mass of pixels.

In this case, in forming the data signal line DL, the data signal line DL is formed in a state that the data signal line DL is overlapped to respective one-end peripheries of the semiconductor layers PS4, PS5. This provision is made to constitute overlapped portions of the data signal line DL as one-side electrodes (drain electrodes) of the thin film transistors TFT4, TFT5.

Here, another electrodes of the thin film transistors TFT4, TFT5 are formed simultaneously with the formation of the data signal line DL, for example, wherein another electrodes are formed in a pattern in which another electrodes slightly extend in the region of the pixel. Another electrode of the thin film transistors TFT4 is provided for the connection with a gate electrode GT2 of the thin film transistor TFT2 described later via a through hole, while another electrode of the thin film transistors TFT5 is provided for the connection with a gate electrode GT1 of the thin film transistor TFT1 described later via a through hole.

Further, in forming the data signal line DL, respective electrodes of the thin film transistors TFT3, TFT6 are simultaneously formed. That is, one electrode of the thin film transistor TFT3 is formed in a pattern in which one electrode slightly extends in the region of the pixel. This provision is made to allow one electrode of the thin film transistor TFT3 to be connected with the gate electrode GT1 of the thin film transistor TFT1 described later via a through hole. Another electrode of the thin film transistor TFT3 extends until another electrode is overlapped to a second gate signal line GL2 of another pixel arranged close to the pixel (arranged close to the first gate electrode GL1 of the pixel) and another electrode is connected with the second gate signal line GL2 via a through hole which is preliminarily formed in a first insulation film arranged below another electrode at the extending end.

Further, one electrode of the thin film transistor TFT6 is formed in a pattern in which one electrode slightly extends in the region of the pixel. This provision is made to allow one electrode of the thin film transistor TFT6 to be connected with the gate electrode GT2 of the thin film transistor TFT2 described later via a through hole. Another electrode of the thin film transistor TFT6 extends until another electrode is overlapped to a first gate signal line GL1 of another pixel arranged close to the pixel (arranged close to the second gate electrode GL2 of the pixel) and another electrode is connected with the first gate signal line GL1 via a through hole which is preliminarily formed in the first insulation film arranged below another electrode at the extending end.

Further, both of the common voltage signal line CLl and the common voltage signal line CLr are, in the inside of the pixel region, formed in a state that projecting portions PJ which extend in the direction which intersects the extending direction are arranged in parallel in the extending direction. The projecting portions PJ are formed in the same manner in the inside of the neighboring pixel region thus forming a so-called fishbone pattern as a whole. These projecting portions PJ constitute one electrode (a group of electrodes) of the thin film transistor TFT1 on the common voltage signal line CLl side, while constitute one electrode (a group of electrodes) of the thin film transistor TFT2 described later on the common voltage signal line CLr side.

Further, another electrodes of the thin film transistors TFT1, TFT2 are formed simultaneously with the formation of the common voltage signal line CL, for example. Another electrode of the thin film transistor TFT1 is constituted as a group of electrodes in which respective electrodes thereof are arranged in a state that the respective electrodes (the above-mentioned projecting portions PJ) of the above-mentioned one group of electrodes are sandwiched between the electrodes of another electrode and, at the same time, another electrode forms a comb-shaped pattern for establishing an electrical connection. In the same manner, another electrode of the thin film transistor TFT2 is constituted as a group of electrodes in which respective electrodes thereof are arranged in a state that the respective electrodes (the above-mentioned projecting portions PJ) of the above-mentioned one group of electrodes of the thin film transistor TFT2 are sandwiched between the electrodes of another electrode and, at the same time, another electrode forms a comb-shaped pattern for establishing an electrical connection.

In the inside of the pixel, using the data signal line DL as a boundary, the semiconductor layers PS1, PS2 are formed separately from each other in a state that the semiconductor layer PS1 is formed in the left-side region and the semiconductor layer PS2 is formed in the right-side region.

The semiconductor layer PS1 and the semiconductor layer PS2 are, although not shown in the drawing, formed on portions corresponding to regions indicated by the gate electrode GT1 and the gate electrode GT2 described later (regions surrounded by a dotted line in the drawing), for example.

This is because that the semiconductor layer PS1 is constituted as a semiconductor layer of the thin film transistor TFT1 described later and the semiconductor layer PS2 is constituted as a semiconductor layer of the thin film transistor TFT2 described later.

Further, a second insulation film (not shown in the drawing) is formed on the surface of the insulation substrate in a state that the second insulation film also covers the respective semiconductor layers PS1 and PS2. The second insulation film functions as gate insulation films of the thin film transistors TFT1, TFT2 described later and a film thickness of the second insulation film is set in conformity with the gate insulation films.

On a surface of the second insulation film, the gate electrode GT1 of the thin film transistor TFT1 and the gate electrode GT2 of the thin film transistor TFT2 are formed. The gate electrode GT1 of the thin film transistor TFT1 is formed on the region where the semiconductor layer PS1 is formed in an overlapped manner and an extended portion of the gate electrode GT1 is connected with the source electrode ST3 of the thin film transistor TFT3 via a through hole TH3 formed in the second insulation film arranged below the gate electrode GT1, and is also connected with the source electrode ST5 of the thin film transistor TFT5 via a through hole TH5. In the same manner, the gate electrode GT2 of the thin film transistor TFT2 is formed on the region where the semiconductor layer PS2 is formed in an overlapped manner and an extended portion of the gate electrode GT2 is connected with the source electrode ST4 of the thin film transistor TFT4 via a through hole TH4 formed in the second insulation film arranged below the gate electrode GT2. Further, the extended portion of the gate electrode GT2 is connected with a source electrode ST6 of the thin film transistor TFT4 via a through hole TH6.

A pixel electrode PX is formed on a surface of the insulation substrate by way of a third insulation film (not shown in the drawing) in a state that the pixel electrode PX also covers the respective gate electrodes GT1, GT2. The pixel electrode PX is formed over a substantially whole area of the pixel region for enhancing a so-called numerical aperture of the pixel and is connected with another electrodes (electrodes different from the electrodes which are integrally formed with the common voltage signal line CL) of the thin film transistors TFT1, TFT2 via through holes TH which are formed in the third insulation film and the second insulation film arranged below the pixel electrode PX in a penetrating manner. In this case, portions where the through holes TH are formed respectively adopt a pattern in which the portions corresponding to the gate electrodes GT1, GT2 are preliminarily notched to avoid the exposure of the gate electrodes GT1, GT2. This pattern is provided for preventing the electrical connection between the pixel electrode PX and the respective gate electrodes GT1, GT2.

Here, between the pixel electrode PX and the electrode (the electrode formed integrally with the common voltage signal line CL) of one of the thin film transistors TFT1, TFT2, capacitances C1 and C2 which use the second insulation film and the third insulation film as dielectric films are formed.

Over a whole area of an upper surface of the pixel electrode PX, an organic EL layer EL (not shown in the drawing) is formed. In this case, in the same manner as the embodiment 1, a charge transport layer, an electron transport layer or the like may be stacked including the organic EL layer EL.

Further, a power source supply signal line PL is formed on an upper surface of the light emitting layer. The power source supply signal line PL is formed in common over the regions of the respective pixels, that is, over the whole area of a display part which is constituted of a mass of the respective pixels. Here, the power source supply signal line PL is formed of a light-transmitting conductive layer which is made of ITO (Indium Tin Oxide), IZO (Indium Zinc Oxide) or the like, for example as a material thereof. This is because that this embodiment is directed to the structure which allows light from the light emitting layer to be irradiated to a front surface of a paper surface of the drawing.

Here, in the above-mentioned constitution, the thin film transistors TFT3 to TFT6 adopt the so-called inversely-staggered structure which forms the gate electrode (gate signal line GL) below the semiconductor layers PS3, PS4. However, it is needless to say that the constitution is not limited to such inversely staggered structure and the staggered structure which forms the gate electrode above the semiconductor layers may be adopted.

In the same manner, although the thin film transistors TFT1, TFT2 are constituted as the staggered structure, the thin film transistor TFT1, TFT2 may be constituted as the inversely-staggered structure in the same manner as the case of the embodiment 1.

Further, although the thin film transistors TFT1, TFT2 are formed in an overlapped manner on the light emitting region in the inside of the pixel, that is, on the region where the organic EL layer EL is formed, the formation of the thin film transistors TFT1, TFT2 is not limited to such a region and the thin film transistors TFT1, TFT2 may be formed in the inside of another region which is separated from the light emitting region as viewed in a plan view in the same manner as the case of the embodiment 1.

Further, the thin film transistors TFT1, TFT2 can largely enhance the ON current and when amorphous silicon, for example, is used as a material of the semiconductor layers PS1, PS2, since the mobility of electrons in the amorphous silicon is relatively small, by adopting the above-mentioned constitution, it is possible to overcome the drawback in the same manner as the case of the embodiment 1.

In the above-mentioned respective embodiments, with respect to the projecting portions of the common voltage signal lines which constitute either one of the source electrodes and drain electrodes of the drive switching elements TFT1, TFT2, distal end portions thereof are formed in a rectangular convex shape and the gap defined between the projecting portions is formed in a rectangular concave shape, while with respect to the comb electrodes which constitute another of the source electrodes and drain electrodes of the drive switching elements TFT1, TFT2, distal end portions thereof are formed in a rectangular convex shape and the gap defined between the distal portions are formed in a rectangular concave shape. Accordingly, in a strict sense, a distance between a corner of one electrode (convex) and a corner of an indentation (concave) between another electrodes and a distance between electrodes in the region where the common voltage signal line and the comb electrodes are arranged substantially in parallel differ from each other (widened by root of 2 times based on a simple calculation). That is, although the channel width is increased, particularly, a width of the electrodes is increased, a channel length is not fixed.

Accordingly, by adopting a curved shape (a semicircular convex distal end shape and a semicircular concave indentation shape) where a bottom shape of the concave and a distal end shape of the convex correspond to each other (assimilation of brim shapes in a strict sense), it is possible to set a distance between electrodes, that is, the channel length to a fixed value.

Here, it is not always necessary to form both of the concave and the convex in a curved shape. When the width of the convex distal end is small, the distal end is considered as a spot and hence, irrespective of the strict shape thereof, by forming the concave shape into a curved shape such as a semicircular shape or a partially elliptical shape, it is possible to largely improve the driving characteristic of the TFT.

The above-mentioned embodiments may be used in a single form or in combination. This is because that the respective embodiments can obtain the advantageous effects thereof independently and synergistically.

What is claimed is:

1. A display device including a circuit for sequentially inputting at least a first scanning signal and a second scanning signal to the pixel, the first scanning signal and the second scanning signal having a relationship that when an ON signal is inputted as one scanning signal and an OFF signal is inputted as another scanning signal, the relationship is changed over during a scanning step, wherein the circuit includes a first gate line for inputting the first scanning signal and a second gate line for inputting the second scanning signal and, wherein the pixel includes at least:

a light emitting element, and a first switching element and a second switching element which supply a power source to the light emitting element through either one of the switching elements;

a fifth switching element which is driven by the ON signal of the first scanning signal and supplies the OFF signal of the second scanning signal to a gate electrode of the first switching element, and a sixth switching element which is driven by the ON signal of the second scanning signal and supplies the OFF current of the first scanning signal to a gate electrode of the second switching element;

a third switching element which is driven in response to the ON signal of the second scanning signal, and a fourth switching element which is driven in response to the ON signal of the first scanning signal;

wherein the third switching element and the fourth switching element are both configured to receive a same data signal on a data line which is common to the third and fourth switching elements;

a first capacitive element which stores a charge corresponding to the data signal through the third switching element and also drives the first switching element, and a second capacitive element which stores a charge corresponding to the data signal through the fourth switching element and also drives the second switching element.

2. A display device according to claim 1, wherein the changeover of ON/OFF of the first scanning signal and the second scanning signal is performed for respective frames.

3. A display device according to claim 1, wherein the first switching element and the second switching element have respective channel regions thereof formed in a zigzag pattern.

4. A display device according to claim 1, wherein the first switching element and the second switching element are formed on a side below a light emitting layer and one electrode formed above the light emitting layer is formed of a light-transmitting conductive layer.

5. A display device according to claim 1, wherein both of the first switching element and the second switching element are formed of a N-channel-type transistor.

6. A display device according to claim 1, wherein both of the first switching element and the second switching element have a semiconductor layer thereof formed of amorphous silicon.

* * * * *